US007152592B2

(12) United States Patent
Rosemann

(10) Patent No.: US 7,152,592 B2
(45) Date of Patent: Dec. 26, 2006

(54) IGNITION COIL FOR A COMBUSTION ENGINE

(75) Inventor: Friedhelm Rosemann, Lüdenscheid (DE)

(73) Assignee: Pulse GmbH (DE)

( * ) Notice: Subject to any disclaimer, the term of this patent is extended or adjusted under 35 U.S.C. 154(b) by 141 days.

(21) Appl. No.: 11/041,019

(22) Filed: Jan. 21, 2005

(65) Prior Publication Data

US 2005/0184847 A1 Aug. 25, 2005

(30) Foreign Application Priority Data

Jan. 22, 2004 (DE) ..... 10 2004 003 216

(51) Int. Cl.
*F02P 1/00* (2006.01)
*H01H 51/22* (2006.01)

(52) U.S. Cl. ..... 123/634; 336/90

(58) Field of Classification Search ..... 123/634, 123/635; 336/90, 92, 96
See application file for complete search history.

(56) References Cited

U.S. PATENT DOCUMENTS 4,514,712 A 4/1985 McDougal
4,658,799 A * 4/1987 Kusaka et al. ..... 123/622
6,457,229 B1 * 10/2002 Kanazawa et al. ..... 29/602.1
6,545,415 B1 * 4/2003 Ward ..... 315/56
6,763,816 B1 * 7/2004 Nakabayashi et al. ..... 123/634
6,897,755 B1 * 5/2005 Wada et al. ..... 336/90
2003/0128090 A1 * 7/2003 Paul et al. ..... 336/96

FOREIGN PATENT DOCUMENTS

DE 197 02 438 C1 1/1997
DE 100 57 567 A1 11/2000
EP 0 796 993 A2 3/1997

* cited by examiner

*Primary Examiner*—John T. Kwon
(74) *Attorney, Agent, or Firm*—Harness, Dickey & Pierce, P.L.C.

(57) ABSTRACT

An ignition coil includes a primary coil carrying primary coil body, a low voltage connection area and a secondary coil inductively coupled with the primary coil for the provision of a high voltage for a spark plug of the combustion engine. The secondary coil is carried on a secondary coil body concentrically enclosed by the primary coil body. A high voltage connection area is provided, in which the secondary coil contacts the spark plug. The secondary coil body encloses a cylindrical, magnetic core, and primary coil body and secondary coil body are both surrounded by an electrically and magnetically conductive shell. The shell includes a longitudinal slit therethrough. The primary coil includes an uneven number of layers. A remote extending coil lead from the low voltage connection is led along the longitudinal slit of the shell. The coil lead runs at least partially within the outer perimeter of the shell.

22 Claims, 1 Drawing Sheet

IGNITION COIL FOR A COMBUSTION ENGINE

CROSS-REFERENCE TO RELATED APPLICATIONS

This application claims the benefit of German Patent Application No. 10 2004003216.5, filed Jan. 22, 2004. The disclosure of the above application is incorporated herein by reference.

FIELD OF THE INVENTION

The present invention relates to combustion engines, and more particularly to an ignition coil for a combustion engine.

BACKGROUND OF THE INVENTION

The invention concerns an ignition coil for a combustion engine with a cylindrical primary coil body carrying a primary winding, a low voltage connection area for connection of the primary coil to a low voltage, a secondary coil inductively coupled with the primary coil, for providing a high voltage for a spark plug of the combustion engine, whereby the secondary coil is carried on a secondary coil body that is concentrically enclosed by the primary coil body, a high voltage connection area, in which the secondary coil contacts the spark plug, whereby the secondary coil body encloses a cylindrical magnetic core, and the primary coil body and the secondary coil body are both enclosed by an electrically and magnetically conductive tube, whereby the tube includes a longitudinal slot therethrough, as well as a method for the production thereof.

An ignition coil of this type is disclosed in DE 100 57 567. Of these types of ignition coils, the invention concerns the so-called "bar coils for ignition components of combustion engines", which include a long design, whereby they can be positioned in the available narrowly bordered space within the combustion engine. A primary voltage fits on the primary coil over the low voltage connection area, which, because of the inductive coupling between primary and secondary coils, is available as high transforming voltage on the high voltage connection area of the secondary coil and there meets the spark plug. With known ignition coils is provided a magnetic circuit through the primary and secondary coils as well as the cylindrical magnetic core and the magnetically conductive tube. To reduce eddy current losses in the also electrically conductive tube, a longitudinal slot is disposed therethrough, so that the induced electrical eddy currents are minimized.

Because of the demands placed on the ignition coil, it is necessary to wind the primary coil several times on the primary spool body that surrounds the secondary coil. With an even number of coil layers, both leads of the primary coil extend from the same end of the primary spool body, so that a direct connection of the low voltage lead can be achieved there. If, however, the number of coil layers is uneven, the coil leads extend from opposite ends of the primary coil body, which means one of the coil leads must be led back from the opposite side to the low voltage connection area. In practice, the primary coil is required to have an uneven number of coil layers, for example three. Because of the required electrical parameters of the ignition coil, a two layer coil is often insufficient, whereas a four layer primary coil would result in too large of a coil diameter.

With the ignition coils known in the art, feed back of the coil lead is achieved by including a groove on the interior of the primary coil body, within which the lead is led back. This does disadvantageously feature that this groove on one hand provides a mechanical weak point of the ignition coil and on the other hand, the electromagnetic field about the lead has a disadvantageous effect on the physical properties of the ignition coil. Another solution known in the art provides that the electrical lead back is achieved through a flat leader, for example in the form of a foil, which stretches along the cylindrical surface of the primary spool body. This solution is also unsatisfactory with respect to the mechanical properties, expensive with respect to the manufacturability and fraught with risk.

SUMMARY OF THE INVENTION

For the above-described reasons, the present invention takes as its basis the objective of further developing an ignition coil of the above-named type with the result of achieving an improved mechanical and electrical reliability in cases of an odd number layer count of the primary winding.

This objective is resolved according to the present invention, whereby with a primary coil 1 having (2n−1), n=1, 2, 3, . . . layers, the remote extending coil lead from the low voltage connection is led along the area of the longitudinal slit of the shell, whereby it runs at least partially within the outer perimeter of the shell.

The invention provides that the feed back of the coil lead occurs through a space, which must be already available in the construction so that no additional constructive measures are necessary, like for example the manufacture of a groove. As a result, no additional mechanical breaking point can develop. Electrically considered, the longitudinal slit for the feed back of the lead is a conceivable opportune location, which is so removed from the electrically active area of the primary and secondary spool, that no influence occurs on the electromagnetic characteristics. On the other side, the feed back of the lead requires no increase in the construction volume of the spool, where the diameter of the lead, possibly inclusive of its insulation, is so calculated, that it is always positioned within the outer periphery of the complete ignition coil, which is bounded through the outer perimeter of the shell.

The process related aspect of the invention includes the particular advantage that the fixing of the lead is easily enabled within the area of the longitudinal slit.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
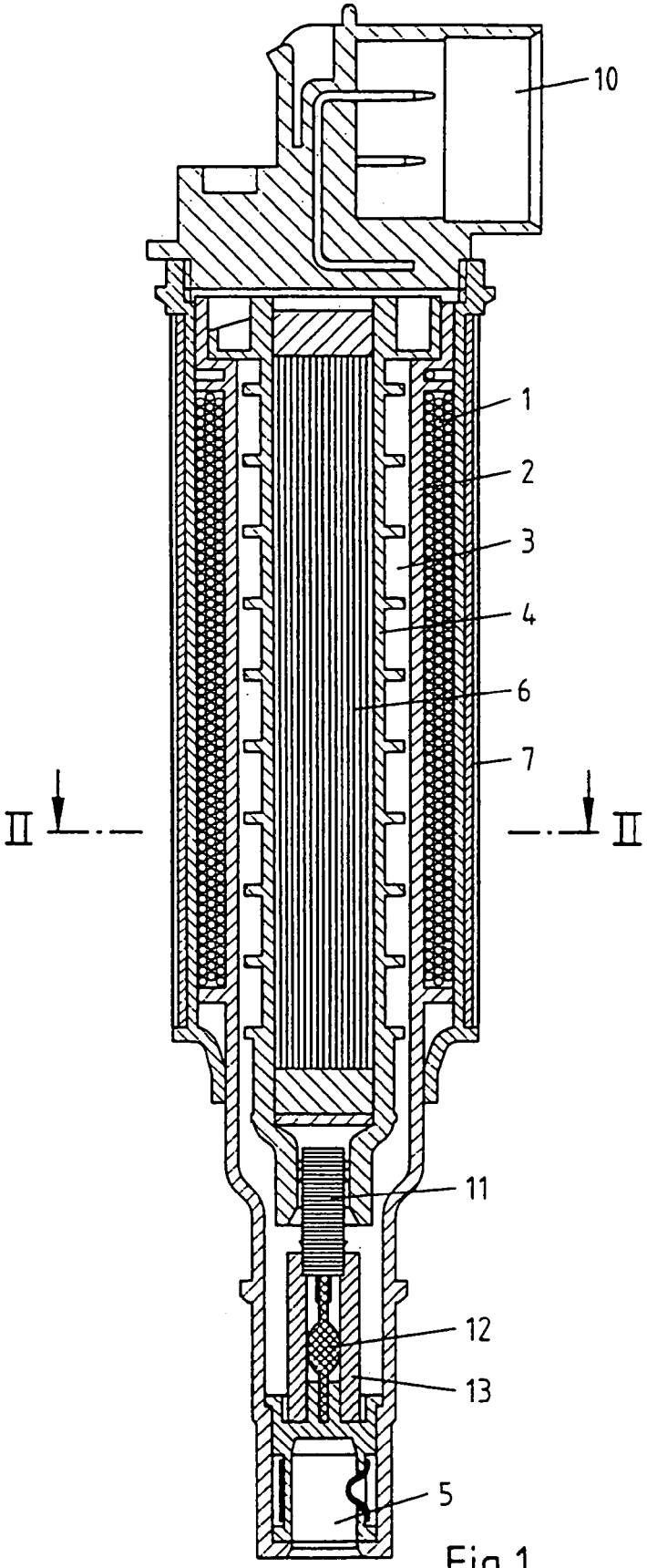
FIG. 1 is a longitudinal cross-section through a ignition coil according to an exemplary embodiment of the invention.
Figure 2:
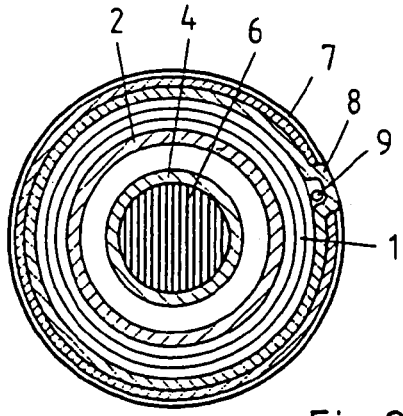
FIG. 2 a section along the line A—A in FIG. 1.

FIG. 1 illustrates a longitudinal cross-section through an exemplary embodiment of the ignition coil of the invention, which in its upper area includes a low voltage connection 10, on which the ignition coil is discharged with the required low voltage. In its lower area, the ignition coil includes a high voltage connection area 5, in which a connection section leads to a spark plug (not illustrated).

The ignition coil includes a cylindrical construction. In the interior of the ignition coil, a cylindrical, magnetic core 6 is provided, which is comprised of laminated, magnetic sheets, ferro-silicon sheets in particular. Individual magnetic sheets of different widths are so stacked and bound under insulation of the individual sheets against one another to form the core 6 with approximately a circular contour. The core 6 is enclosed by a secondary coil body 4, which carries a secondary coil 3 that is electrically connected to the high voltage area 5. The connection of the secondary coil 3 with the high voltage area 5 is achieved on the whole over a shielding electrical resistor 11 and a rectifier diode 12, which is accommodated within a housing 13.

The secondary coil body 4 is concentrically surrounded by a primary coil body 2, which carries a primary coil 1. The primary coil 1 is a three layer coil in the illustrated exemplary embodiment. The coil unit is surrounded by a shell 7, which is made up of an electrically conductive and at the same time magnetically conductive material, in particular ferro-silicon sheet or a stainless steel. A wall thickness of the shell is within the exemplary range of 0.8 to 1.2 mm and is preferably 1 mm.

The shell 7 can be constructed of multiple layers (e.g., two layers). In the illustrated embodiment, the shell 7 is defined by two opposing insulated roll formed magnetic sheets. The outer circumference of the shell 7 at the same time defines the outer periphery of the described ignition coil. The shell 7, the primary coil 1, the secondary coil 3 and the core 6 define a magnetic circuit for the generation of the required ignition energy, with which the spark plug is discharged. On the basis of reducing the eddy currents in the area of the magnetically conductive shell 7, the shell 7 is provided with a longitudinal slit 8 therethrough. Along the longitudinal slit 8 stretches one of the leads of the primary coil 1 and actually, the one which is led out in the lower area of the primary coil 1 from the primary coil body 2 and must be bound with the low voltage connection 10 like the upper sided, extending from the primary coil body 2 lead.

The coil lead 9 running along the longitudinal slit 8 includes a diameter within an exemplary range of 0.5 to 0.8 mm, and preferably includes a diameter of 0.75 mm. The coil lead includes an insulated covering and is secured within the slit by an embedding material. The embedding material is preferably a binding material including an epoxy resin.

The cylindrical formed area between the extension of the ends of the secondary coil 3 and the high voltage connection 5 serves for the accommodation of a resistor 11 serving as a suppressor element and also for the accommodation of a diode 12, through which a rectification is passively achieved of the in the spark plug flowing current, whereby the negative effective impulse for the ignition is allowed through and the positive disrupting impulse is however suppressed.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An ignition coil that discharges to a spark plug of a combustion engine, comprising:

a primary coil body carrying a primary coil;

a secondary coil body carrying a secondary coil that is inductively coupled with the primary coil, wherein the secondary coil body and the secondary coil are concentrically enclosed by the primary coil body;

an electrically and magnetically conductive shell, whereby the shell encloses the primary and secondary coil bodies and includes a longitudinal slit therethrough;

wherein the primary coil includes (2n−1) (n=1, 2, 3, . . . ) layers and a remote extending coil lead of the primary coil is led along the longitudinal slit of the shell, whereby the coil lead runs at least partially within the outer perimeter of the shell.

2. The ignition coil of claim 1 wherein the primary coil includes three layers.

3. The ignition coil of claim 1 wherein a wall thickness of the shell is within 0.8 to 1.2 mm.

4. The ignition coil of claim 1 wherein the shell includes a soft-magnetic sheet.

5. The ignition coil of claim 1 wherein the shell includes one of an Fe—Si sheet and a stainless steel sheet.

6. The ignition coil of claim 1 wherein the shell is built of multiple layers.

7. The ignition coil of claim 1 wherein the coil lead running along the slit area includes a diameter within 0.5 to 0.8 mm.

8. The ignition coil of claim 1 wherein the coil lead running along the slit area includes an insulated covering.

9. The ignition coil of claim 1 wherein the coil lead running along the slit area is embedded in an insulating compound.

10. An ignition coil for a combustion engine, comprising:

a primary coil body carrying a primary coil;

a low voltage connection area for connection of the primary coil to a low voltage;

a secondary coil inductively coupled with the primary coil for the provision of a high voltage for a spark plug of the combustion engine, whereby the secondary coil is supported by a secondary coil body concentrically enclosed by the primary coil body;

a high voltage connection area, in which the secondary coil contacts the spark plug, whereby the secondary coil body encloses a cylindrical magnetic core, and the primary coil body and the secondary coil body are both surrounded by an electrically and magnetically conductive shell, whereby the shell includes a longitudinal slit therethrough;

wherein the primary coil includes (2n−1) (n=1, 2, 3, . . . ) layers and a remote extending coil lead of the primary coil from the low voltage connection is led along the longitudinal slit of the shell, whereby the coil lead runs at least partially within the outer perimeter of the shell.

11. The ignition coil of claim 10 wherein the primary coil includes three layers.

12. The ignition coil of claim 10 wherein a wall thickness of the shell is within 0.8 to 1.2 mm.

13. The ignition coil of claim 10 wherein the shell includes a soft-magnetic sheet.

14. The ignition coil of claim 10 wherein the shell includes one of an Fe—Si sheet and a stainless steel sheet.

15. The ignition coil of claim 10 wherein the shell is built of multiple layers.

16. The ignition coil of claim 10 wherein the coil lead running along the slit area includes a diameter within 0.5 to 0.8 mm.

17. The ignition coil of claim 10 wherein the coil lead running along the slit area includes an insulated covering.

18. The ignition coil of claim 10 wherein the coil lead running along the slit area is embedded in an insulating compound.

19. A method of manufacturing an ignition coil for a combustion engine, comprising:

winding a primary coil to include (2n−1), (n=1, 2, 3, . . . ) layers;

enclosing the primary coil within a shell having a longitudinal slit therethrough; and extending a remote coil lead from a low voltage connection along the longitudinal slit of the shell, whereby the coil lead fixedly runs at least partially within an outer perimeter of the shell.

20. The method of claim 19 wherein the primary coil includes three layers.

21. The method of claim 19 wherein the shell includes one of an Fe—Si sheet and a stainless steel sheet.

22. The method of claim 19 further comprising embedding the coil lead in an insulating compound.

* * * * *